US006446460B1

(12) United States Patent
Rosenberg

(10) Patent No.: US 6,446,460 B1
(45) Date of Patent: Sep. 10, 2002

(54) METHOD OF CHILLING AND CONSUMING AN ALCOHOLIC BEVERAGE AND APPARATUS THEREFOR

(75) Inventor: Neil Rosenberg, Barrington, RI (US)

(73) Assignee: NAR, Inc., Barrington, RI (US)

( * ) Notice: Subject to any disclaimer, the term of this patent is extended or adjusted under 35 U.S.C. 154(b) by 0 days.

(21) Appl. No.: 09/986,787

(22) Filed: Nov. 9, 2001

Related U.S. Application Data

(62) Division of application No. 09/826,816, filed on Apr. 6, 2001.

(51) Int. Cl.[7] ..... F25D 3/08
(52) U.S. Cl. ..... 62/457.3; 62/457.4; 62/371
(58) Field of Search ..... 62/457.1, 457.2, 62/457.7, 457.4, 457.8, 458, 459, 371, 340, 1; 220/592.16, 62.12, 740

(56) References Cited

U.S. PATENT DOCUMENTS 2,501,772 A * 3/1950 Guard ..... 62/34
2,501,905 A * 3/1950 Leather et al. ..... 62/91.5
5,934,099 A * 8/1999 Cook et al. ..... 62/457.2

* cited by examiner

*Primary Examiner*—William C. Doerrler
*Assistant Examiner*—Melvin Jones
(74) *Attorney, Agent, or Firm*—Burns, Doane, Swecker & Mathis, LLP

(57) ABSTRACT

To chill an alcoholic beverage, the beverage is poured into at least one shotglass which is then lidded to form an air-tight seal. The lidded shotglass is inserted into a refrigeration compartment, whereby the alcoholic beverage is chilled to a temperature at or below 0° F. The lidded shotglass is removed from the refrigeration compartment when it is desired to consume the alcoholic beverage, and the chilled alcoholic beverage is drunk directly from the shotglass after removing the lid. A number of the lidded shotglasses can be placed in a thermally insulative container, whereafter the container is placed in the refrigeration compartment to chill the alcohol.

8 Claims, 3 Drawing Sheets

METHOD OF CHILLING AND CONSUMING AN ALCOHOLIC BEVERAGE AND APPARATUS THEREFOR

This application is a divisional application of Ser. No. 09/826,816 filed on Apr. 6, 2001.

BACKGROUND OF THE INVENTION

The present invention relates to the chilling and consumption of alcoholic beverages, especially vodka.

In recent years, lower-priced and mid-priced vodkas have been losing market share, while premium, superpremium and flavored vodkas are more than making up for the loss with a total increase in annual sales.

Besides using vodka as a mixer in alcoholic beverages, drinking straight vodka has developed wide appeal with the increasing number of high quality products available. As a result, it has become a popular trend and preference to drink chilled shots of vodka. It is generally perceived that when consuming vodka that has been cooled to subfreezing temperatures, it has a softer non-medicinal taste and smoother finish. This preference lead to the development of a commercially available dispensing machine marketed by Stolichnaya Vodka called the Stoli Cold Shot Machine. As a refrigerated unit, it can hold up to eight bottles of vodka and selectively dispense any one at approximately 30° F. This enables bars and restaurants to meet consumer demand for chilled shots of vodka.

There are striking and obvious differences between the taste of vodka at average room temperature (70° F.) and subfreezing (30° F.) temperatures. However, an equally dramatic difference in taste occurs when vodka is further cooled to temperatures of zero (0° F.) or below.

Ideally, premium vodka should be kept in a freezer at all times, ready for consumption at zero or subzero temperature. Vodka's high alcohol content prevents it from freezing, and the liquid becomes surprisingly viscous. When chilled to subzero temperatures, fine vodka is at its proper thick creamy consistency and texture. The subtle flavor remains but with a significantly softer finish, making it easy to consume and enjoy.

Besides being drunk very cold, vodka is customarily gulped down in a single swallow, the liquid being tossed far back in the mouth. A possible reason for this, as claimed by the Russians, is a practical one: if vodka is sipped, one inhales the fumes and the fumes are what cause drunkenness faster than the drink itself.

For those that prefer to drink vodka chilled to subzero temperatures, the only means available is to place a bottle in a freezer and dispense it directly into a shotglass that is typically at room temperature. Under these conditions, vodka contained in the bottle and the shotglass warm rapidly, creating a small window of opportunity to consume vodka at the proper temperature.

It would be desirable to provide a convenient way of chilling an alcoholic beverage such as vodka and then consuming the beverage from a shotglass without the beverage becoming appreciably warmed.

SUMMARY OF THE INVENTION

This object is achieved by chilling a pre-dispensed alcoholic beverage and drinking the beverage directly from a shotglass into which was pre-dispensed and chilled. In particular, a method aspect of the invention comprises a method of chilling and consuming a n alcoholic beverage, comprising the steps of:

A) pouring an alcoholic beverage into a shotglass;

B) installing a lid onto the shotglass to form an air-tight seal therewith;

C) inserting the lidded shotglass into a refrigeration compartment to chill the alcoholic beverage therein;

D) removing the lidded shotglass from the refrigeration compartment;

E) removing the lid; and

F) drinking the chilled alcoholic beverage directly from the shotglass.

The invention also pertains to the lidded shotglass per se.

The invention also pertains to an apparatus comprising a container which includes a base and a removable cover for the base. The base and the cover together form an interior space. The base includes pockets disposed in the space. The base and the cover are formed of a thermally insulative material suited for insulating at a temperature at or below 0° F. Shotglasses are removably disposed in respective pockets. A removable lid is provided for each shotglass.

BRIEF DESCRIPTION OF THE DRAWINGS

The objects and advantages of the invention will become apparent from the following detailed description of a preferred embodiment thereof in connection with the accompanying drawings in which like numerals designate like elements and in which.

DETAILED DESCRIPTION OF PREFERRED EMBODIMENTS OF THE INVENTION

Figure 1:
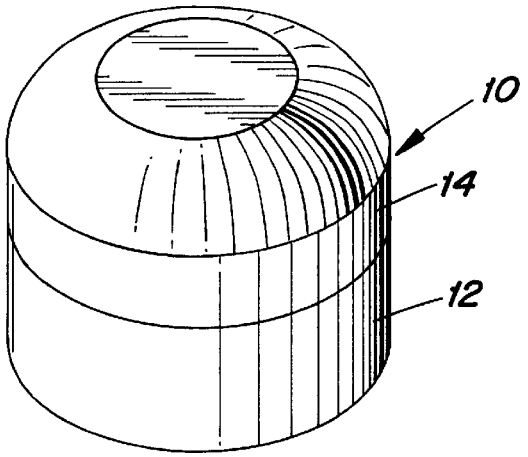
FIG. 1 is a top perspective view of a container according to the present invention, wherein a cover of the container is installed on a base of the container.
Figure 2:
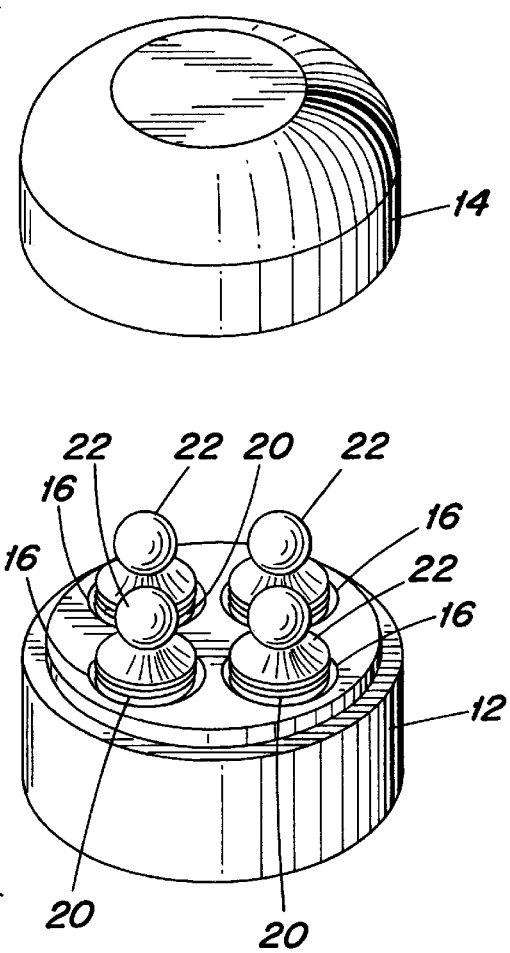
FIG. 2 is an exploded top perspective view of the container depicted in FIG. 1, with the cover of the container removed to expose an interior space of a container.
Figure 3:
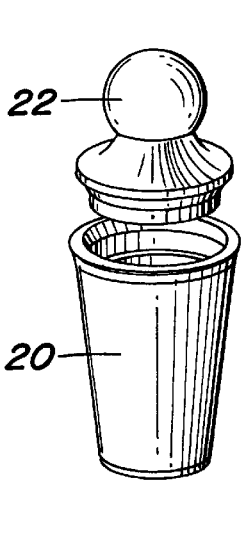
FIG. 3 is an exploded top perspective view of a shotglass and lid therefor which is adapted for use with the container shown in FIGS. 1 and 2.

Depicted in FIGS. 1 and 2 is a container 10 comprising a base 12 and a removable cover 14, each preferably made of a thermally insulative material rated to insulate below 30° F.

Figure 4:
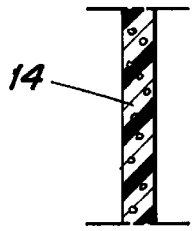
FIG. 4 is a sectional view taken through one type of wall structure of the container.

The base and cover could be cast or machined directly from a highly thermally insulative material 14 (see FIG. 4), such as a conventional syntactic foam which contains hollow micro-spheres, formed of glass for example, available from Emerson & Cuming Specialty Polymers of Canton, Mass. (a division of Imperial Chemical Co.). Other highly thermally insulative materials that could be used include, but are not limited to: (i) Core-Cell® which is a linear polymer foam that is non-friable, tough, rigid and has a closed-cell structure (ATC Chemical Corp., Buffalo, N.Y.); (ii) ICA-LITE brand expanded polystyrene insulation which is a rigid closed cell, light-weight plastic foam (Insulation Corp. of America, Allentown, Pa.), (iii) Divinycell H grade (Divinycell International of Denmark), and (iv) ceramics.

Figure 5:
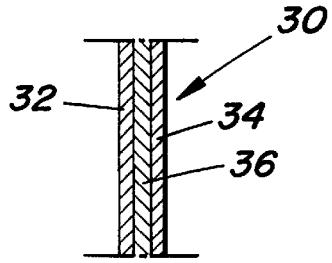
FIG. 5 is a sectional view taken through an alternative wall structure of the container.

Alternatively, the base and cover could each be formed as a hollow shell-like structure 30 having spaced walls 32, 34 forming an area filled with a conventional phase-change insulative material 36 which changes between liquid and solid states in accordance with temperature (see FIG. 5). Such phase change materials are available from Phase Change Inc. of San Diego, Calif.

Still alternatively, the base and cover could be injection-molded, or cast of a conventional self-skinning foam comprised of polyurethane, epoxy, etc.

The base 12 and the cover 14 together form an interior space. The base 12 includes at least one, but preferably a plurality of recesses or pockets 16 disposed in the space for receiving a corresponding number of drinking vessels in the shape of lidded shotglasses 20. By "shotglass" is meant a vessel having a thick sidewall 20*a* and thick base 20*b* with no stem or foot at the base. A shotglass of the "short shot" or "pony shot" variety holds from 1.0 to about 1.5 oz. of liquid, whereas a so-called "double" shot holds from 2 to about 3 oz. of liquid.

Figure 11:
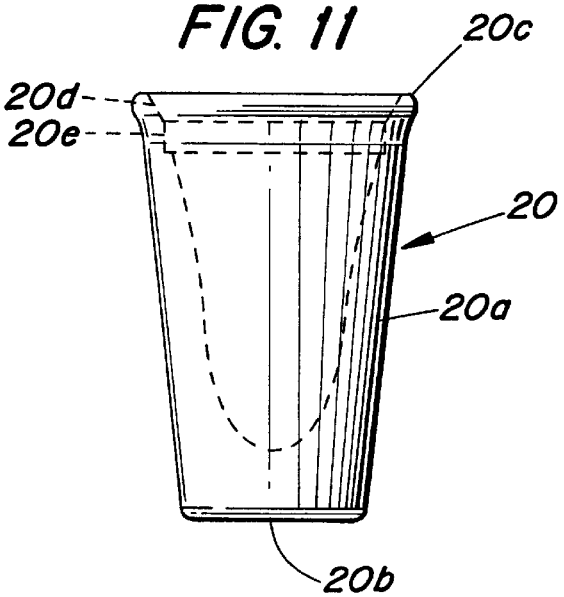
FIG. 11 is a side view of the shotglass.
Figure 10:
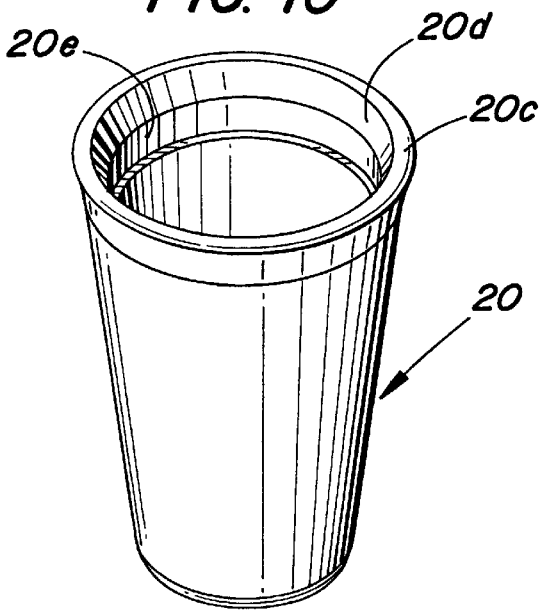
FIG. 10 is a top perspective view of a shotglass.
Figure 12:
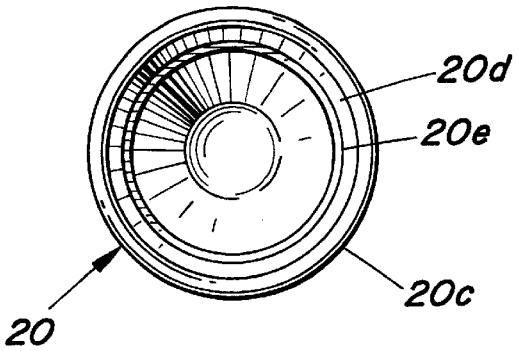
FIG. 12 is a top view of the shotglass.
Figure 13:
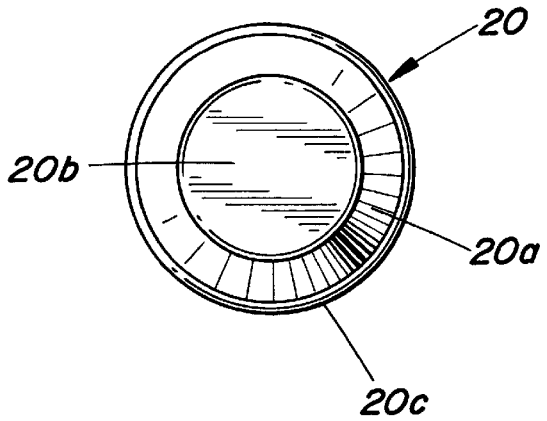
FIG. 13 is a bottom view of the shotglass.
Figure 14:
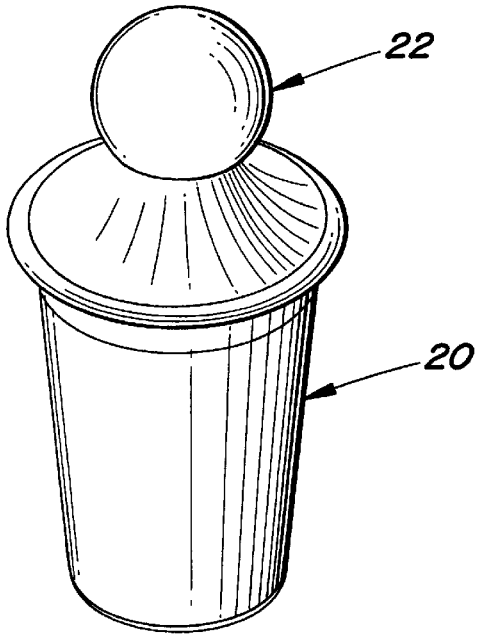
FIG. 14 is a top perspective view of a lidded shotglass.

The shotglass 20 includes a rim 20*c* and an interior surface including an upper portion 20*d* which extends downwardly from the rim in a slightly convexly shaped manner having a radius r (see FIGS. 10–11).

The upper portion 20*c* transforms into a portion 20*e* which is cylindrical or near-cylindrical (i.e., the portion 20*e* could taper slightly downwardly).

Figure 6:
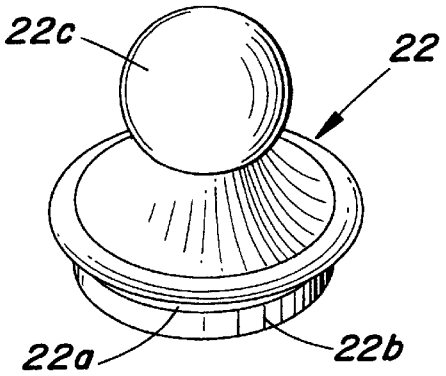
FIG. 6 is a top perspective view of a lid for a shotglass.
Figure 7:
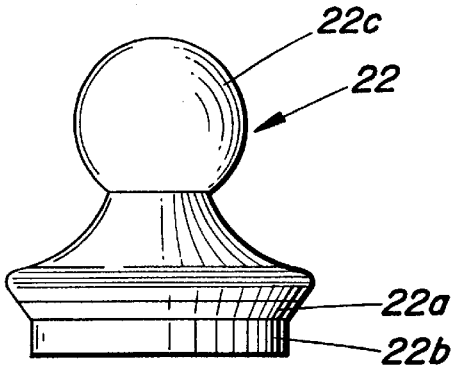
FIG. 7 is a side view of the lid.
Figure 8:
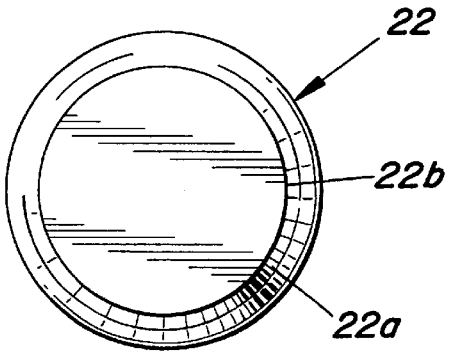
FIG. 8 is a bottom view of the lid.
Figure 9:
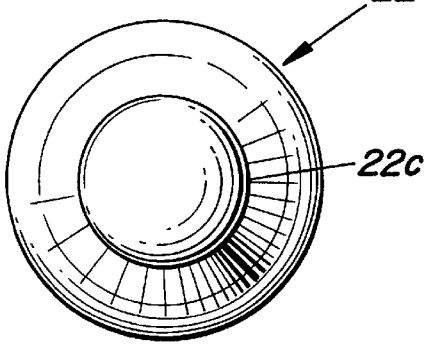
FIG. 9 is a top view of the lid.

A lid 22 for the shotglass includes a base 22 shaped to fit snugly in essentially air-tight sealing fashion in the shotglass (see FIGS. 6–7). Thus, the profile of the outer wall of the base includes a concave curvature 22*a* with a radius at least substantially equal to the radius of the upper portion 20*d* of the inside surface of the shotglass. The concave portion 22*a* transforms into a cylindrical (or near-cylindrical) portion 22*b* which coincides with the portion 20*e* of the shotglass and fits snugly therein to form an airtight seal. The air-tight seal is important, since it is desirable to isolate the alcohol from odors or moisture which could alter the flavor. The air-tight seal also serves to minimize evaporation of alcohol disposed in the shotglass. The lid is provided with a handle structure enabling a user to grip and carry the lid. Any suitable handle structure will suffice, such as a sphere 22*c*.

Figure 15:
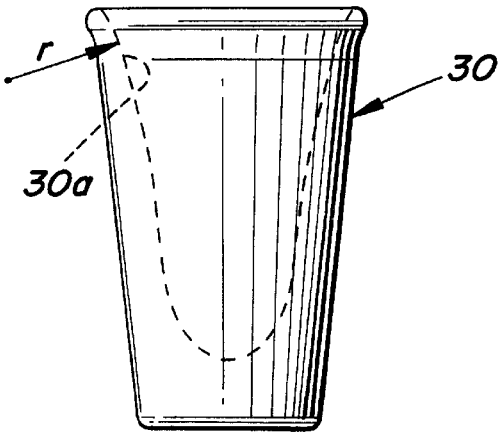
FIG. 15 is a side view of an alternative form of shotglass according to the invention.
Figure 16:
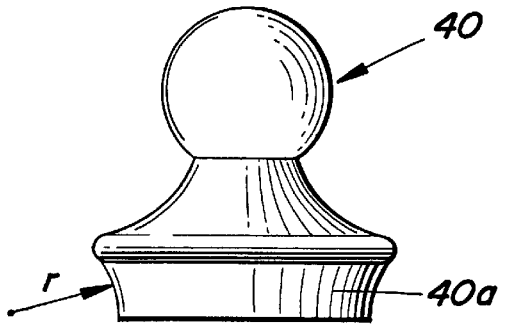
FIG. 16 is a side view of an alternative form of lid adapted to fit the shotglass of FIG. 15.

Alternative shapes for the shotglass 30 and the lid 40 are depicted in FIGS. 15–16. In that embodiment, the cylindrical portion 20*e* of FIG. 11 is omitted. Rather, the convexly curved portion 30*a* extends a greater distance. The concavely curved surface 40*a* on the lid 40 is correspondingly configured.

The shotglass 20 and the lid 22 are formed of the same material, e.g., crystal, glass, borosilicate, sapphire, metal, ceramic, etc.

In use, a consumer pours an alcoholic beverage, such as vodka, into the shotglasses 20, installs the lids 22, and places the lidded shotglasses into the respective pockets 16 of the base 12 of the container 10, as shown in FIG. 2. The container thus constitutes a common container for the shotglasses 20. The container 10 is then placed in a refrigeration compartment, preferably a freezer compartment of a conventional refrigerator (not shown), whereupon the shotglasses and the alcohol become chilled, preferably to a temperature at or below 0° F. When it is desired to consume the alcohol, the container 10 is removed from the refrigeration compartment. The cover 14 is removed from the base 12, and one or more of the shotglasses 20 is removed from the base. After removing the lid(s) 22, the vodka can be consumed directly from the shotglass 18 without being transferred to a room-temperature vessel. Thus, the vodka will not be appreciably warmed before being consumed.

If less than all of the shotglasses 20 are initially removed from the base 12, the cover 14 can be replaced on the base 12, and the consumer has the option of returning the container to the refrigeration compartment, or leaving the container out of the refrigeration compartment. Even if the container is left out, the temperature of the shotglasses 20 remaining in the container will be maintained for a considerable period, due to the highly insulative nature of the container material.

By chilling a pre-dispensed alcoholic beverage into a shotglass and drinking the chilled beverage directly from the shotglass, the beverage can be drunk in its fully chilled state. It will be appreciated that the lidded shotglasses 20, 22 can be utilized with or without the container 10. That is, one or more of the lidded shotglasses could be filled with alcohol and chilled in the refrigeration compartment without being placed in a container 10.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of chilling and consuming an alcoholic beverage, comprising the steps of:

A) pouring an alcoholic beverage into a shotglass;

B) installing a lid onto the shotglass to form an air-tight seal therewith;

C) inserting the lidded shotglass into a refrigeration compartment to chill the alcoholic beverage therein;

D) removing the lidded shotglass from the refrigeration compartment;

E) removing the lid; and

F) drinking the chilled alcoholic beverage directly from the shotglass.

2. The method according to claim 1 wherein step C comprises chilling the alcoholic beverage to a temperature at or below 0° F.

3. The method according to claim 1 wherein step A comprises pouring the alcohol beverage into a shotglass having a capacity not exceeding 1.5 ounces.

4. The method according to claim 1 wherein step A comprises pouring the alcoholic beverage into a shotglass having a capacity not exceeding three ounces.

5. Apparatus for providing an alcoholic beverage comprising a shotglass and a lid for the shotglass shaped for achieving an air-tight seal therewith, the shotglass including a bottom-most edge and a sidewall, the sidewall including an outer surface extending upwardly from the bottom-most edge at an outward inclination wherein the outer surface tapers downwardly to the bottom-most edge, the shotglass having a maximum liquid-carrying volume no greater than substantially three ounces.

6. The apparatus according to claim 5 wherein the sidewall includes an interior surface having an upper portion, wherein a lower portion of an outer surface of the lid enters the shotglass and contacts the upper portion of the interior surface to form the air-tight seal.

7. The apparatus according to claim 6 wherein the upper portion of the interior surface becomes smaller in a downward direction, the lower portion of the outer surface of the lid being shaped correspondingly to the upper portion of the interior surface.

8. The apparatus according to claim 7 wherein the upper portion of the interior surface is convexly shaped, and the outer surface of the lower portion of the lid is concavely shaped.

* * * * *